US005651685A

United States Patent [19]

Brinkman et al.

[11] Patent Number: 5,651,685

[45] Date of Patent: Jul. 29, 1997

[54] ELECTRICAL CONNECTOR WITH SENSING TERMINAL SYSTEM

[75] Inventors: Donald J. Brinkman, Bolingbrook; Philip J. Dambach, Naperville; Jerry A. Long, Elgin, all of Ill.

[73] Assignee: Molex Incorporated, Lisle, Ill.

[21] Appl. No.: 602,672

[22] Filed: Feb. 16, 1996

[51] Int. Cl.[6] ..... H01R 9/09

[52] U.S. Cl. ..... 439/79; 439/490

[58] Field of Search ..... 439/188, 607–610, 439/488, 489, 29

[56] References Cited

U.S. PATENT DOCUMENTS

| | | | |
|---|---|---|---|
| 4,804,339 | 2/1989 | Cohen | 439/588 |
| 5,174,787 | 12/1992 | Shirai et al. | 439/489 |
| 5,273,456 | 12/1993 | Muzslay | 439/489 |
| 5,281,165 | 1/1994 | McCleerey et al. | 439/510 |

*Primary Examiner*—Khiem Nguyen
*Attorney, Agent, or Firm*—A. A. Tirva

[57] ABSTRACT

A sensing terminal system is disclosed for an electrical connector. The system includes a first terminal adapted for connection to a voltage potential. A second terminal includes a first part and a second part, with the two parts being electrically isolated. The first part is adapted for connection to a sensing line. The two parts are electrically coupled in response to mating of a mating terminal with the second terminal. The second part of the second terminal is electrically coupled with the first terminal to complete a sensing circuit therethrough.

25 Claims, 5 Drawing Sheets

ELECTRICAL CONNECTOR WITH SENSING TERMINAL SYSTEM

FIELD OF THE INVENTION

This invention generally relates to the art of electrical connectors and, particularly, to an electrical connector which includes a sensing terminal system for sensing the mating of the connector with a second connector or other appropriate connecting device.

BACKGROUND OF THE INVENTION

There are many electrical connector applications wherein it is important to detect when a pair of connectors have been fully mated. Many detection systems use mechanical means which simply are visible to an operator to indicate whether or not a pair of connectors have been fully mated. However, connectors often are used in remote applications wherein visible detection is not afforded or may not even be appropriate. In those applications, some system of electrical detection has been used.

For example, electrical connectors are used in automotive applications, such as in anti-locking brake systems which require electronic means for indicating full connector mating to a computer that monitors functions of various parts of the automobile. Automotive air bag systems also require some form of sensing system to assure reliable interconnection of various electrical connectors. These are but a few examples of remote connector arrangements wherein it is important or even vital to sense full mating of pairs of electrical connectors.

Various connector mate sensing devices have been proposed. One such device is shown in U.S. Pat. No. 5,174,787, dated Dec. 29, 1992. In that patent, a connector assembly includes a completely separate pair of pin and socket terminals which mate only after the connector halves have been mated. The separate terminals complete a circuit whereby a signal is sent to indicate full mating of the connectors. One of the disadvantages of such systems is that they require a customized connector assembly having a completely separate set of sensing terminals and appropriate circuitry.

Other approaches use shorting modules such as in U.S. Pat. No. 5,281,165, dated Jan. 25, 1994. Again, the connector, including the connector housing, must be modified to accept the shorting modules.

Still other sensing systems are shown in U.S. Pat. Nos. 4,804,339, dated Feb. 14, 1989, and 5,273,456, dated Dec. 28, 1993. The systems of these patents generally employ a pair of terminals or a pair of terminal portions which are maintained in interengagement to complete a sensing circuit. When the associated connector is mated with a second connector, a portion of the second connector separates the terminals or terminal portions, breaking the normally closed circuit, and thereby providing a sensing signal that mating of the connectors has occurred. Again, such systems have the disadvantage of requiring customized housings or housing portions to render the system operative.

The present invention is directed to providing a greatly simplified and low cost connector mate sensing system which can be used in a conventional electrical connector without modifying the housing from its normal terminal-receiving configuration.

SUMMARY OF THE INVENTION

An object, therefore, of the invention is to provide a new and improved sensing terminal system for an electrical connector.

In the exemplary embodiment of the invention, the sensing terminal system includes a first female terminal adapted for connection to a voltage potential. A second female terminal includes a first part and a second part, with the two parts being electrically isolated. The first part is adapted for connection to a sensing line. The two parts are electrically coupled in response to mating of a male terminal with the second female terminal. Means are provided for electrically coupling the second part of the second female terminal with the first female terminal.

As disclosed herein, the first female terminal and the second part of the second female terminal are integral in a unitary structure stamped of sheet metal material. The first and second female terminals are insert molded in a dielectric housing to form a terminal module. The first female terminal and the first part of the second female terminal include tail portions for coupling to circuit traces on a printed circuit board.

Although the concepts of the invention are disclosed herein as incorporated in a pair of female terminals, the invention is readily applicable for other types of terminals, such as male terminals, pin terminals, socket terminals and the like.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
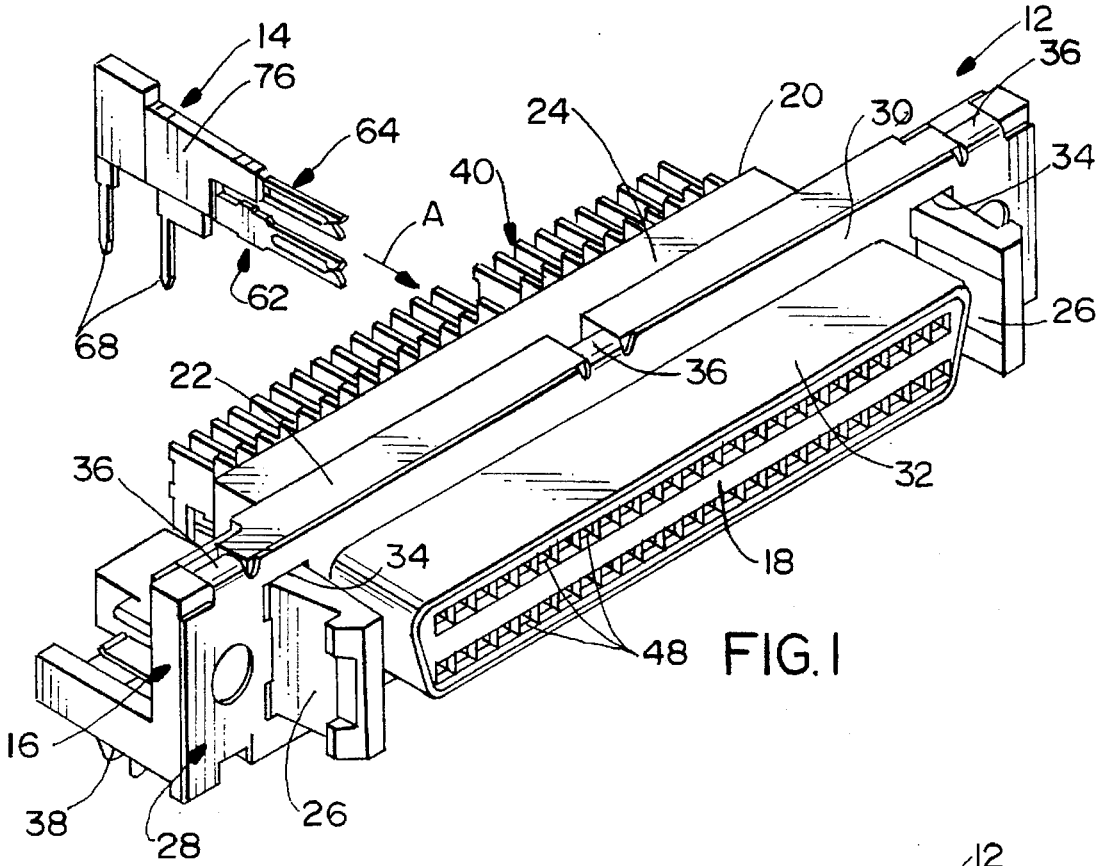
FIG. 1 is a perspective view of an electrical connector, with the sensing module about to be inserted thereinto.

Referring to the drawings in greater detail, and first to FIG. 1, the invention is incorporated in a conventional electrical connector, generally designated 12, into which a sensing module, generally designated 14, is inserted or assembled. Connector 12 is a shielded input/output (I/O) connector, but the concepts of the invention are applicable for a wide variety of electrical connectors or connecting devices.

Figure 2:
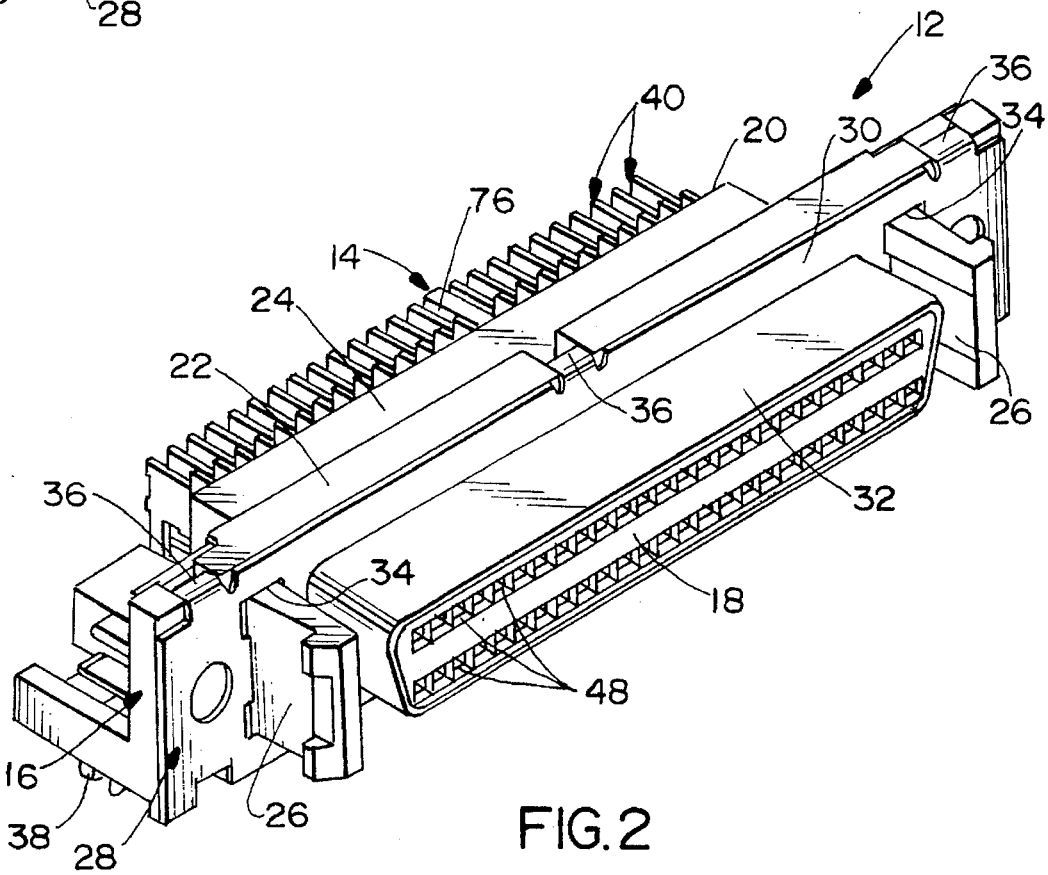
FIG. 2 is a view similar to that of FIG. 1, with the sensing module inserted into the connector.
Figure 3:
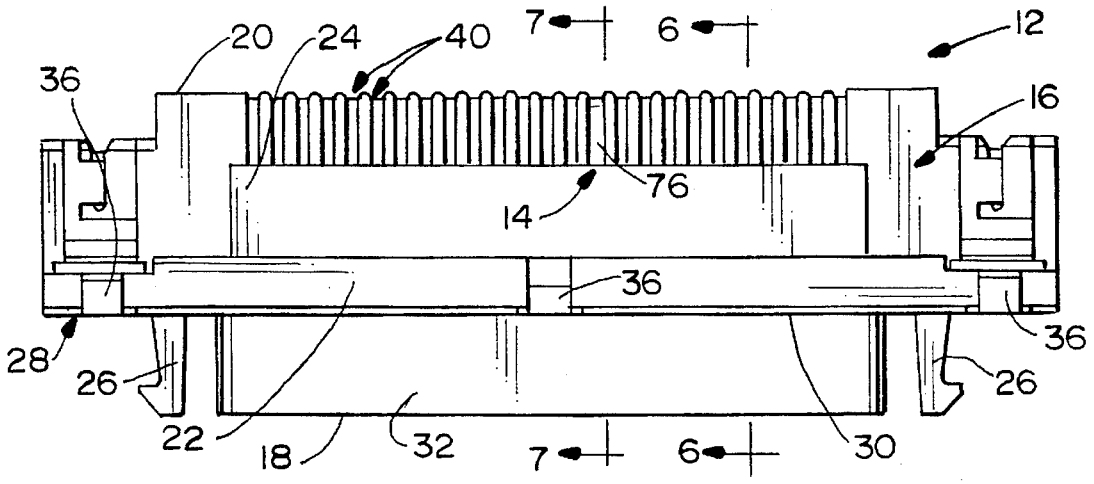
FIG. 3 is a top plan view of the connector of FIG. 2.
Figure 4:
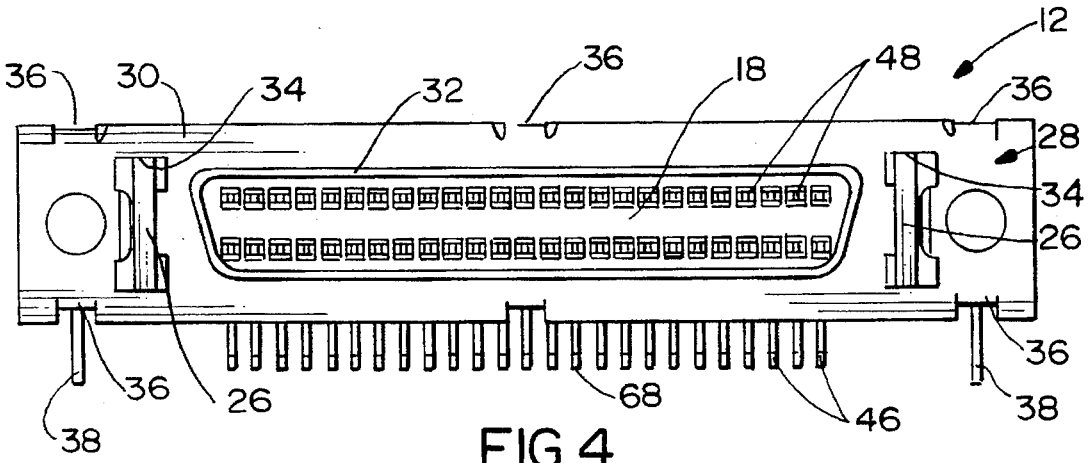
FIG. 4 is a front elevational view of the connector.
Figure 5:
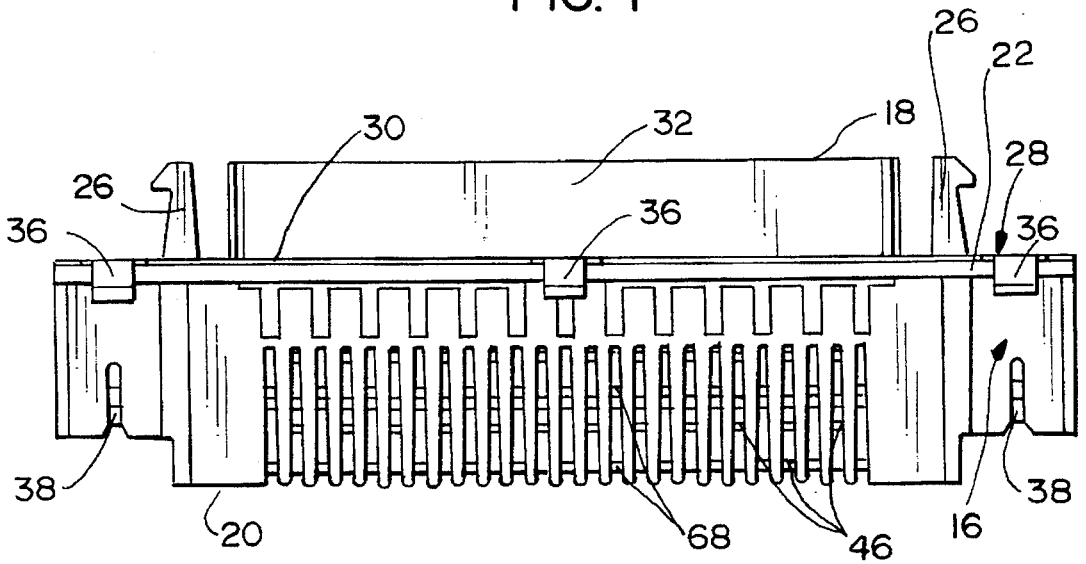
FIG. 5 is a bottom plan view of the connector.

More particularly, referring to FIGS. 3–5 in conjunction with FIGS. 1 and 2, electrical connector 12 includes a dielectric housing, generally designated 16, which defines a front mating end 18 and a rear terminating end 20. The front mating end 18 actually is formed by a conventional D-shaped plug projecting forwardly of a flange 22 having a rearwardly projecting portion 24. The housing is unitarily molded of dielectric material, such as plastic or the like, and includes a pair of forwardly projecting latch arms 26 which latch with appropriate latching means of an appropriate mating second connector (not shown).

Connector 12 further includes a shield, generally designated 28, which includes a plate portion 30 for abutting against the front of housing flange 22, along with a shroud portion 32 which projects forwardly and surrounds the housing plug at mating end 18. Latch arms 26 of the housing project through openings 34 in plate portion 30 of the shield. Tabs 36 project rearwardly of plate portion 30 to facilitate mounting the shield onto flange 22 of housing 16. Lastly, the housing has at least a pair of bifurcated mounting pegs 38 for insertion into appropriate mounting holes in a printed circuit board to mount the connector on the board.

Figure 6:
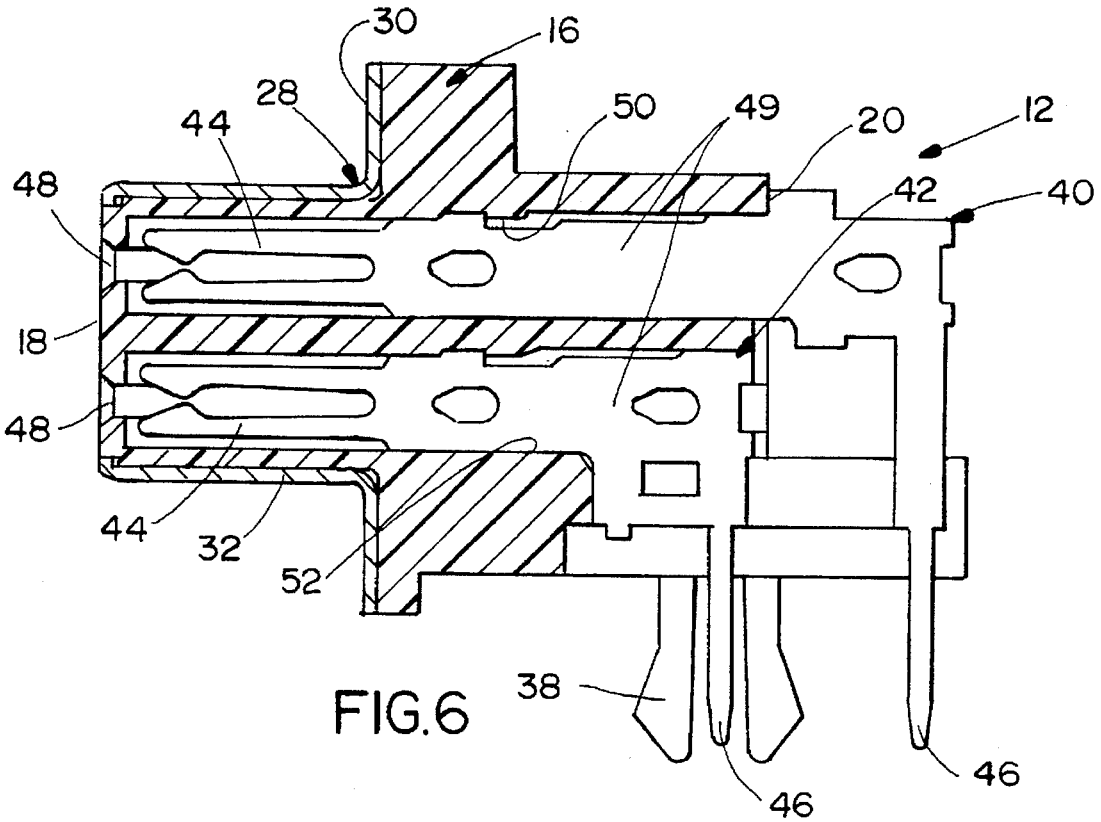
FIG. 6 is a vertical section taken generally along line 6—6 of FIG. 3.

Referring to FIG. 6 in conjunction with FIGS. 1–5, pairs of female signal terminals, generally designated 40 and 42, are mounted longitudinally along the length of connector 12. Each terminal 40 and 42 includes a female mating or contact end 44 and a terminating end 46. Contact ends 44 of each pair of terminals 40 and 42 are in vertical alignment as shown best in FIGS. 1 and 4 to define a series of pairs of female contact ends lengthwise of connector housing 16. The female contact ends are in transverse alignment with openings 48 in the plug portion of the housing at mating end 18, again as best seen in FIGS. 1 and 4. Male terminals or pins of the complementary second connector are inserted through openings 48 into engagement with contact ends 44 of female terminals 40 and 42.

As seen clearly in FIG. 6, terminals 40 and 42 have body portions 49 inserted into through passages 50 and 52, respectively, in housing 16 between front mating end 18 and rear terminating end 20 of the housing. The terminals are right-angled terminals, and terminating ends 46 of the terminals project downwardly, generally perpendicular to body portions 49 of the terminals. Therefore, terminating ends 46 of the terminals define tail portions for insertion into appropriate holes in the printed circuit board for connection (as by soldering) to circuit traces on the board and/or in the holes. Therefore, the terminals are effective to interconnect the male contact pins of the second complementary mating connector to the circuit traces on the printed circuit board.

Figure 7:
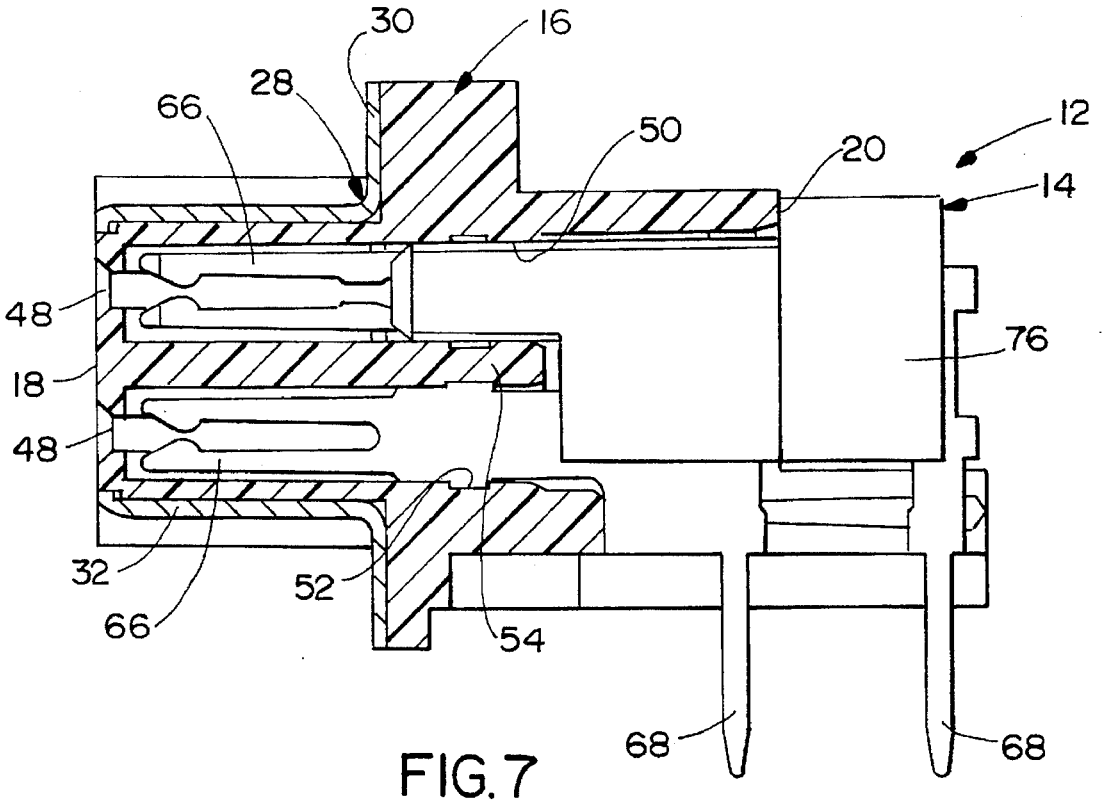
FIG. 7 is a vertical section taken generally along line 7—7 of FIG. 3.

Referring to FIG. 7, sensing module 14 is shown inserted into housing 16 of connector 12 at a particular position that normally could be occupied by a pair of the normal signal terminals 40 and 42 described above in relation to FIG. 6. In other words, it should be understood that the dimensional parameters of the housing are not modified. The entire sensing module simply occupies a selected position of a pair of the signal terminals 40 and 42. The only modification is that a partition 54 between passages 50 and 52 is shortened as shown in FIG. 7 in comparison to FIG. 6. Otherwise, the size and spacing of the terminal passages and the size and dimensional parameters of the housing are not changed to any extent. In addition, as will be seen below, the mating and terminating ends of the terminals within sensing module 14 are identical to those of the normal signal terminals 40 and 42, as can be seen in comparing FIGS. 6 and 7.

Figure 8:
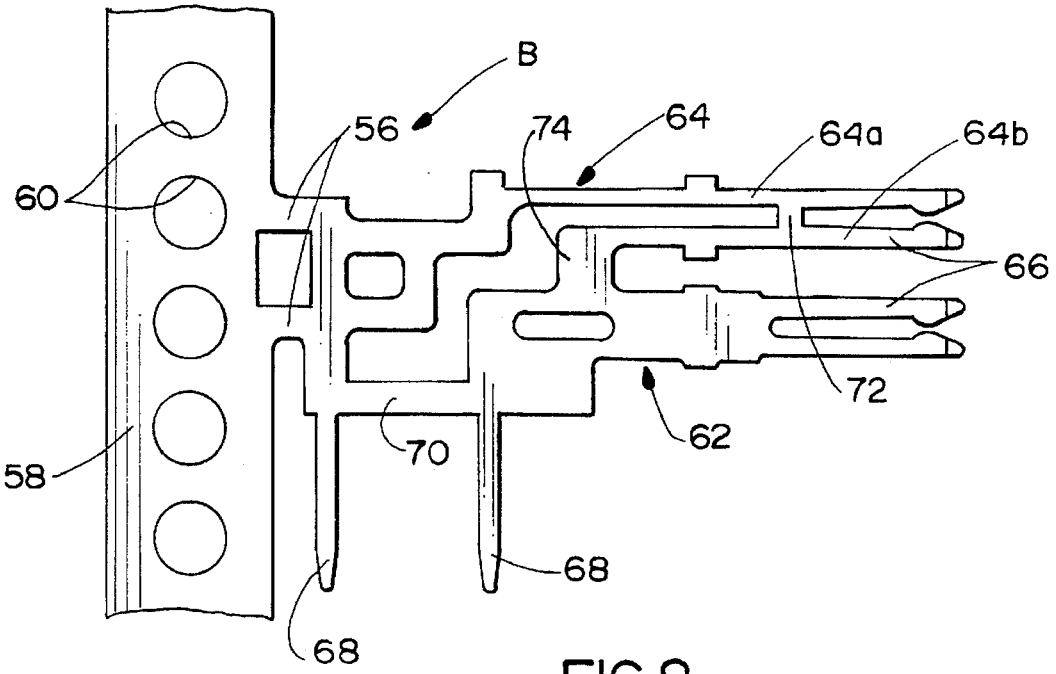
FIG. 8 is a plan view of a stamped blank from which the terminals of the sensing module are formed.

FIG. 8 shows the terminals which are incorporated in sensing module 14, in their stamped configuration from a blank "B" of conductive sheet metal material. The terminals still are joined by web portions 56 to a carrier strip 58 having machine indexing apertures 60, as is well known in the terminal processing art.

More particularly, FIG. 8 shows that the terminal arrangement within sensing module 14 includes a first terminal, generally designated 62, and a second terminal, generally designated 64. Both terminals have female mating ends 66 which, in comparison to FIG. 6, are identical to female mating ends 44 of normal signal terminals 40 and 42. Terminals 62 and 64 have terminating ends defined by tail portions 68 which are identical to tail portions 46 of normal signal terminals 40 and 42. Therefore, first terminal 62 is adapted for connection to a voltage potential by means of a circuit trace on the printed circuit board, through its tail portion 68, and terminal 64 is adapted for connection to a sensing line or circuit on the printed circuit board, through its tail portion 68. The terminals are shown in FIG. 8 joined by a web portion 70 of the sheet metal material, near tail portions 68. This web portion 70 will be removed prior to inserting the sensing module into the connector.

According to the invention, second female terminal 64 (FIG. 8) of sensing module 14 includes a first part 64*a* and a second part 64*b* which are electrically isolated. At this point, it should be noted that the first and second parts 64*a* and 64*b* of terminal 64 are shown in FIG. 8 joined by a web portion 72 of the sheet metal material. This web portion 72 will be severed prior to inserting the sensing module into the connector. First part 64*a* of terminal 64 is adapted to be connected to the sensing line or circuit on the printed circuit board through tail portion 68 of terminal 64. The second part 64*b* of terminal 64 is electrically coupled and mechanically joined to terminal 62 by a portion 74 of the sheet metal material from which the terminals are stamped. Therefore, the second portion 64*b* of terminal 64 is adapted to be connected to a voltage potential on the printed circuit board through tail portion 68 of terminal 62. With this arrangement, it can be understood that a conductive male pin terminal inserted between parts 64*a* and 64*b* of terminal 64 will complete a sensing circuit on the printed circuit board through tail portions 68 of the two terminals.

Figure 9:
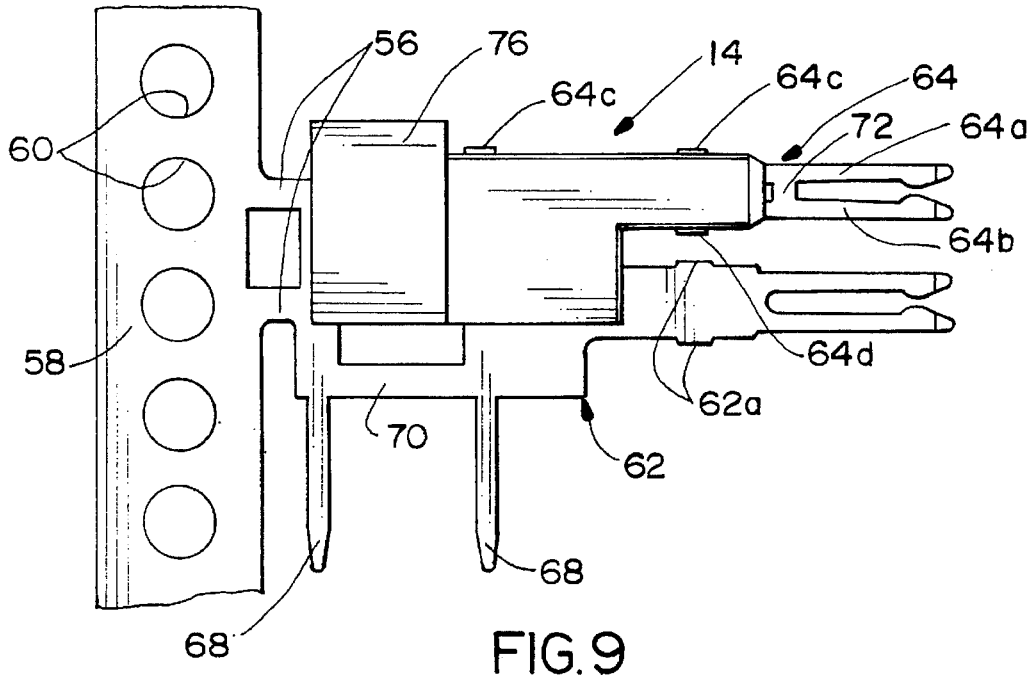
FIG. 9 is a view similar to that of FIG. 8, with portions of the terminals insert molded in a dielectric housing.

FIG. 9 shows terminals 62 and 64 of sensing module 14 rigidly mounted within a dielectric housing 76. The dielectric housing can be overmolded about portions of the terminals as clearly shown in FIG. 9. In essence, the terminals are insert molded within the dielectric housing. It can be seen in FIG. 9 that the terminals still are connected to carrier strip 58 by web portions 56; that the two terminals still are interconnected by web portion 70; and the two parts 64*a* and 64*b* of terminal 64 are interconnected by web portion 72. These web portions facilitate handling of the terminals during the insert molding process.

It can be seen in FIG. 9 that the first part 64*a* of terminal 64 includes a pair of barbs 64*c;* the second part 64*b* of terminal 64 has a barb 64*d;* and terminal 62 has a pair of barbs 62*a*, all of which are exposed outside dielectric housing 76 for biting into the plastic material of connector housing 16 within passages 50 and 52 when the terminal module is inserted into the connector.

Figure 10:
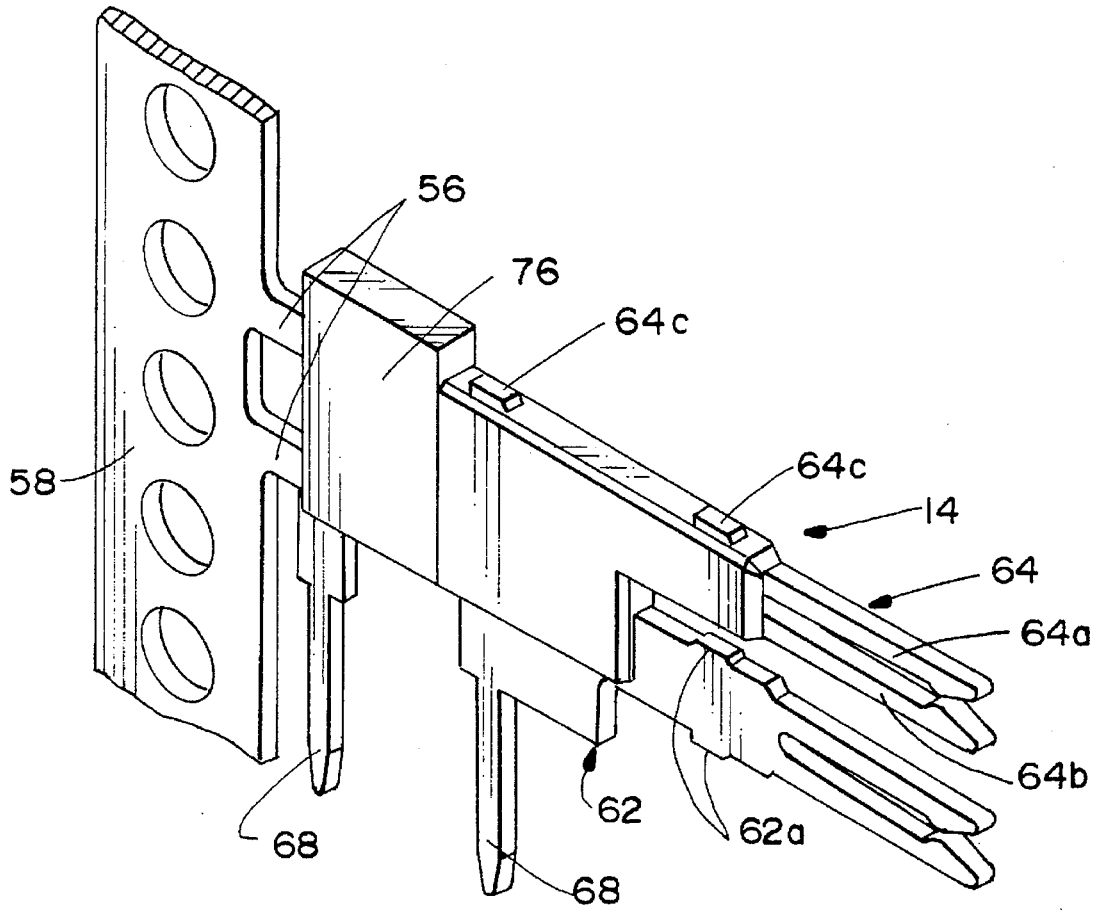
FIG. 10 is a perspective view of the subassembly of FIG. 9, with the joining webs between the terminals and the two parts of the one terminal having been severed.

After terminals 62 and 64 of sensing module 14 are insert molded within dielectric housing 76, web portions 70 and 72 (FIG. 9) are removed as shown in FIG. 10. Therefore, the first and second parts 64*a* and 64*b* of terminal 64 are electrically isolated and, correspondingly, the first part 64*a* of terminal 64 is electrically isolated from terminal 62. The last step then is to sever web portions 56 between sensing module 14 and carrier strip 58, whereby the sensing module now is ready to be inserted into the connector housing in the direction of arrow "A" in FIG. 2, until the sensing module is fully inserted as shown in FIGS. 2–5.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector, a sensing terminal system comprising:

a first female terminal adapted for connection to a voltage potential;

a second female terminal including a first part and a second part with the two parts being electrically isolated, the first part being adapted for connection to a sensing line, and the two parts being electrically coupled in response to mating of a male terminal with the second female terminal; and means electrically coupling the second part of the second female terminal with the first female terminal.

2. In an electrical connector as set forth in claim 1, wherein said first female terminal and the second part of said second female terminal are integral in a unitary structure.

3. In an electrical connector as set forth in claim 2, wherein said unitary structure is stamped of sheet metal material.

4. In an electrical connector as set forth in claim 3, wherein the first part of said second female terminal is stamped of sheet metal material.

5. In an electrical connector as set forth in claim 4, wherein said first and second female terminals are inserted molded in a dielectric housing to form a terminal module.

6. In an electrical connector as set forth in claim 5, wherein said first and second female terminals include retention barbs exposed exteriorly of the dielectric housing.

7. In an electrical connector as set forth in claim 1, wherein said first female terminal and the first part of said second female terminal include tail portions for coupling to circuit traces on a printed circuit board.

8. In an electrical connector, a sensing terminal system comprising:

a first terminal adapted for connection to a voltage potential;

a second terminal including a first part and a second part with the two parts being electrically isolated, the first part being adapted for connection to a sensing line, and the two parts being electrically coupled in response to mating of a mating terminal with the second terminal; and means electrically coupling the second part of the second terminal with the first terminal.

9. In an electrical connector as set forth in claim 8, wherein said first terminal and the second part of said second terminal are integral in a unitary structure.

10. In an electrical connector as set forth in claim 9, wherein said unitary structure is stamped of sheet metal material.

11. In an electrical connector as set forth in claim 10, wherein the first part of said second terminal is stamped of sheet metal material.

12. In an electrical connector as set forth in claim 11, wherein said first and second terminals are inserted molded in a dielectric housing to form a terminal module.

13. In an electrical connector as set forth in claim 12, wherein said first and second terminals include retention barbs exposed exteriorly of the dielectric housing.

14. In an electrical connector as set forth in claim 8, wherein said first terminal and the first part of said second terminal include tail portions for coupling to circuit traces on a printed circuit board.

15. In an electrical connector as set forth in claim 8, wherein the first part of said second terminal is stamped of sheet metal material.

16. In an electrical connector, a mate sensing system comprising:

a dielectric housing including a plurality of pairs of terminal-receiving passages in the housing;

a plurality of pairs of terminals respectively received within the pairs of passages in the housing; and one of said pairs of terminals including a first terminal adapted for connection to a voltage potential, a second terminal including a first part and a second part with the two parts being electrically isolated, the first part being adapted for connection to a sensing line, and the two parts being electrically coupled in response to mating of a mating terminal with the second terminal, and means electrically coupling the second part of the second terminal with the first terminal.

17. In an electrical connector as set forth in claim 16, wherein said first terminal and the second part of said second terminal are integral in a unitary structure.

18. In an electrical connector as set forth in claim 17, wherein said unitary structure is stamped of sheet metal material.

19. In an electrical connector as set forth in claim 18, wherein the first part of said second terminal is stamped of sheet metal material.

20. In an electrical connector as set forth in claim 19, wherein said first and second terminals are inserted molded in a dielectric housing to form a terminal module.

21. In an electrical connector as set forth in claim 20, wherein said first and second terminals include retention barbs exposed exteriorly of the dielectric housing.

22. In an electrical connector as set forth in claim 16, wherein said first terminal and the first part of said second terminal include tail portions for coupling to circuit traces on a printed circuit board.

23. In an electrical connector as set forth in claim 16, wherein the first part of said second terminal is stamped of sheet metal material.

24. A method of fabricating a terminal module for use as a mate sensing system in an electric connector, comprising the steps of:

stamping first and second terminals from conductive sheet metal material, the first terminal being configured for connection to a voltage potential, the second terminal including first and second parts joined by a web of sheet metal material, the first part being configured for connection to a sensing line, and the second part being connected to the first terminal;

molding a dielectric insert about portions of the first and second terminals leaving said web between the first and second parts of the second terminal exposed; and severing said web to electrically isolate the first and second parts of the second terminal whereby the two parts are adapted to be electrically coupled in response to mating of a mating terminal with the second terminal.

25. The method of claim 24 wherein said molding step includes molding the dielectric insert about the point of connection between the first terminal and the second part of the second terminal.

* * * * *